US005832627A

United States Patent [19]

Hiebert

[11] Patent Number: 5,832,627

[45] Date of Patent: Nov. 10, 1998

[54] PRODUCE DRIER SYSTEM USING SUBTENDED HEAT SOURCE AND HEAT RESERVOIR

[75] Inventor: Jacob F. Hiebert, Reedley, Calif.

[73] Assignee: JFH Engineering, Reedley, Calif.

[21] Appl. No.: 771,827

[22] Filed: Dec. 12, 1996

[51] Int. Cl.[6] ..... F26B 17/00

[52] U.S. Cl. ..... 34/580; 34/224

[58] Field of Search ..... 34/426, 476, 548, 34/580, 582, 90, 620, 633, 659, 663, 203, 210, 211, 212, 216, 224, 236; 126/99 R, 110 R

[56] References Cited

U.S. PATENT DOCUMENTS

| | | | |
|---|---|---|---|
| 234,412 | 11/1880 | Lee et al. . | |
| 342,243 | 5/1886 | Caspari . | |
| 1,125,382 | 1/1915 | Nye . | |
| 1,200,775 | 10/1916 | Stevenson . | |
| 1,256,825 | 2/1918 | Parker . | |
| 1,266,983 | 5/1918 | Parker . | |
| 1,283,949 | 11/1918 | Stevenson . | |
| 1,674,414 | 6/1928 | Ridley . | |
| 1,691,874 | 11/1928 | White . | |
| 1,884,344 | 10/1932 | Stevens et al. . | |
| 2,159,047 | 5/1939 | Paxton et al. | 34/12 |
| 3,651,922 | 3/1972 | Ross et al. | 198/127 |
| 4,291,472 | 9/1981 | Lewis | 34/31 |
| 4,352,249 | 10/1982 | Rose | 34/212 |
| 4,472,887 | 9/1984 | Avedian et al. | 34/31 |
| 4,632,835 | 12/1986 | Norris | 426/302 |

*Primary Examiner*—Henry A. Bennett
*Assistant Examiner*—Steve Gravini
*Attorney, Agent, or Firm*—Madson & Metcalf

[57] ABSTRACT

An improved dryer and method for drying the surface of produce and other objects. The dryer has a continuous conveyor for transporting the objects in a substantially horizontal path, a heat reservoir disposed beneath the conveyor for radiating heat, and a drying hood assembly for enclosing a volume above the heat reservoir and the continuous conveyor. The drying hood assembly has a hood, air baffles disposed near the conveyor, and a hood fan to facilitate air flow turbulence about the air baffles within the drying hood assembly. A heat source is provided for heating the heat reservoir. A monitoring system is provided for receiving and interpreting sensory readings received from sensors disposed at locations about the dryer. The monitoring system also provides controlling signals to regulate the drying conditions for objects being conveyed. The method for drying objects includes monitoring drying conditions and regulating the amount of heat generated by the heat source, the speed the conveyor moves, and the operation of fans to maintain optimum drying conditions.

25 Claims, 6 Drawing Sheets

PRODUCE DRIER SYSTEM USING SUBTENDED HEAT SOURCE AND HEAT RESERVOIR

BACKGROUND OF THE INVENTION

1. Field of Invention

This invention relates generally to a produce dryer system and method and, more particularly, to an improved system and method for drying the surface of produce or other objects.

2. Background Art

Fruit dryer conveyor systems are commonly used for drying the wax sprayed on the exterior surfaces of fruit. In addition, similar systems also are used to dehydrate produce either for preservation or in preparation of certain types of products such as raisins or prunes.

Presently, there are a number of ways which are used to effect the drying of wax on the exterior surfaces of produce or to dehydrate produce. For example, one system consists of a series of belt driven conveyors, in a drying chamber, arranged one above the other so as to deliver the fruit from each upper belt to the next lower belt. A series of steam-heating pipes are arranged between the belts and have steam-circulation from the upper pipes to the lower pipes to expose the greenest produce on the upper most belts to the greatest degree of heat.

This system presents several drawbacks. It produces uneven heating as it travels through the drying chamber. The steam pipes have a tendency to "sweat" and drip condensed water onto the produce being dried. Rusting of the insides of the pipes is also inevitable. Finally, no circulation fans are employed in this drying system to circulate the heated air, thus further uneven drying of the fruit will result.

Another system which is commonly used to dry produce consists of a large wind tunnel or chamber in which the produce is stacked in trays. A burner or furnace is placed at one end of the tunnel. The system includes means for circulating the air transversely from top to bottom, and in alternatively reverse horizontal directions through the chambers. This system, however, also suffers from drawbacks. The rising cost of energy coupled with the tremendous expense of operating large, industrial size burners which are used to heat the air before it is forced through the stacked trays of produce make such systems unworkable.

A further disadvantage of such a system is that the air flow through the stacked trays is unevenly distributed. For example, if one tray in the stack is loaded with fruit, air flow across that tray will be impeded. Thus, typically the air temperature will vary from the top of the stacked trays to the bottom of the stack and the moisture content of the air will also vary through the length of the stacked trays of produce. These difficulties increase the waste and further reduce the cost effectiveness of this type of produce drying system.

Another drying system also employs a endless conveyor belt system extending through an enclosed air chamber, but it also uses a heating source introducing heat into circulating air within the chamber located above the produce. The heat is introduced through either electric coils or a gas burner located above the fruit in the chamber. Such a system also contains deformities. Heat rises, but in this system heat is being forced down through the fruit and along the conveyor path. Produce traveling along the conveyor path will experience different heat intensities in such a fruit drying system.

Yet another fruit drying system employs a horizontal bed of rotary brushes, which continually rotate and brush the fruit thereon. A housing confines air in a chamber above the bed of fruit and a stream of hot air is supplied at one end of the chamber, beneath the bed of fruit and at a sufficient rate to compensate for heat losses. Gas burners provide heated combustion gases which are blown directly by a blower into one end of the chamber and along the horizontal path of the fruit.

Several problems exist with the above described system. The combustion gases are blown directly into the chamber carrying the fruit. Dilution of the combustion gases is required to prevent the rotary brushes from being burned. This system also employs baffle plates located beneath the bed of fruit to laterally spread the hot air as it is discharged from the hot air chamber into the space beneath the fruit. However, no other baffles or fan system are used to further facilitate air flow turbulence throughout the drying chamber. As a result, fruit traveling through the drying chamber is unevenly heated. The hot air chamber is lined with a layer of insulation to prevent heat escaping from the chamber. Consequently, the heated air simply rises through the fruit and hovers against the ceiling of the hot air chamber.

What is needed in the art is a system and method for drying produce which evenly distributes heat from below the fruit using a heating source and heat absorbing and radiating reservoir, which employs baffles and a fan system for circulating the heated air about the produce, and which is more energy efficient and time efficient by being computer monitored and controlled for optimum drying in the least amount of time.

SUMMARY OF THE INVENTION

A primary object of this invention is to provide a produce drying system and method which is more energy efficient and which more uniformly dries the produce as it travels through the drying chamber by using a heat source positioned in heat transfer communication with heat absorbing and radiating reservoirs positioned below the conveyed produce.

Another important object of this invention is to provide a system and method for drying produce in which a plurality of heat absorbing and radiating reservoirs each contain a bore.

Another important object of this invention is to provide a system and method for drying produce which employs a dehumidifying chamber and venting system to dehumidify the bore of each heat absorbing and radiating reservoir.

Another important object of this invention is to provide a system and method for drying produce which employs a drying hood assembly for substantially enclosing a volume of air above and around the produce being conveyed. This drying hood assembly also includes circulation fans and air baffles for circulating heated air about the produce being conveyed.

Another important object of this invention is to provide a system and method for drying produce in which the conveyor belt system comprises an endless chain driven by a conveyor drive motor. The conveyor also has a plurality of cylindrical rollers disposed transverse to the path travelled by the endless chain.

Another important object of this invention is to provide a system and method for drying produce in which the cylindrical rollers disposed transverse to the path traveled by the endless chain rotate while the produce is being conveyed to expose all the surfaces of the fruit to the heated, drying air.

Another object of this invention is to facilitate the use of a plastic interlocking belt in place of the cylindrical rollers when dehydrating produce.

Another important object of this invention is to provide a system and method for drying produce which is more energy efficient and time efficient by controlling the operation of the system through a computer or other monitoring and controlling system.

Yet another important object of this invention is to provide a system and method of drying produce which is highly efficient in operation using natural gas as a heat source.

These and other objects and features of the present invention will become more apparent from the following drawings and description, taken in conjunction with the appended claims.

In accordance with the foregoing objects, the present invention provides a system and method for drying or dehydrating produce or other objects. The presently preferred embodiment of the system includes a drying hood assembly that defines a volume of air located above the produce on an endless chain conveyor. The hood assembly has a hood fan to facilitate air flow turbulence within the hood assembly. The hood assembly also has a plurality of air baffles to further facilitate air turbulence and to direct the heated air towards the conveyed produce. The conveyor chain also has a plurality of rollers, preferably cylindrical, disposed transverse to the substantially horizontal path travelled by the endless chain conveyor. The rollers may be rotated while the produce is being conveyed through the hood assembly to rotate the produce and expose all surfaces of the produce to the heated, drying air.

When dehydration of produce is desired, the cylindrical rollers may be replaced by an interlocking belt. The operation parameters of the system are also adjusted for produce dehydration.

The heating source is one or more natural gas burners, or some other acceptable source of heat. The heating source is located beneath the conveyor and is in heat transfer communication with a heat reservoir comprising a plurality of hollow, heat-conductive members, such as metal tubes or pipes, also subtending the conveyor. To enhance the transfer of heat from the heating source to the heat reservoir, burn deflectors are located above the gas burners and angled to channel an optimum amount of heat to the heat-conductive members.

A dehumidifying chamber is connected to the heat reservoir at the end opposite from heating source. The dehumidifying chamber is used to dehumidify the hollow of the heating reservoir to reduce the onset of corrosion and rust. A venting tuyere connects the dehumidifying chamber and a dehumidifying fan which draws the moist air out of the hollow of the heat reservoir and vents it into the atmosphere.

A computer monitoring system receives temperature and other sensory readings from sensors located at various points on the dryer. These readings are compared with predetermined criteria for optimum operation. The computer monitoring system also sends controlling signals to regulate the operation of the hood fan, dehumidifying fan, blowing fan, heating source, and conveyor motor, whereby optimum drying conditions for produce being conveyed may be maintained.

Another embodiment of this invention introduces heated air into the drying chamber below the conveyed produce at the output end of the chamber. A preferable heat source is a 350,000 BTU/HR propane heater. The heated air flows both horizontally below the fruit in a direction opposite to the path traveled by the produce and vertically up through the produce. Air fans and air baffles located throughout the drying chamber facilitate the circulation of the air about the produce to optimize energy efficiency and reduce the time required to dry the produce.

A computer monitoring system receives temperature and other sensory readings from sensors located at various points on the dryer. These readings are compared with predetermined criteria for optimum operation. The computer monitoring system also sends controlling signals to regulate the operation of the hood fans, automatic shutter fans, heating source, and conveyor motor, whereby optimum drying conditions for produce being conveyed may be maintained.

BRIEF DESCRIPTION OF THE DRAWINGS

In order to more fully describe the manner in which the advantages and objects of the present invention are obtained, a more particular description of the presently preferred embodiment of the present invention will be described with additional detail with reference to the drawings, in which like parts are designated with like numerals throughout, and in which.

DETAILED DESCRIPTION OF THE PREFERRED EMBODIMENT

Figure 1:
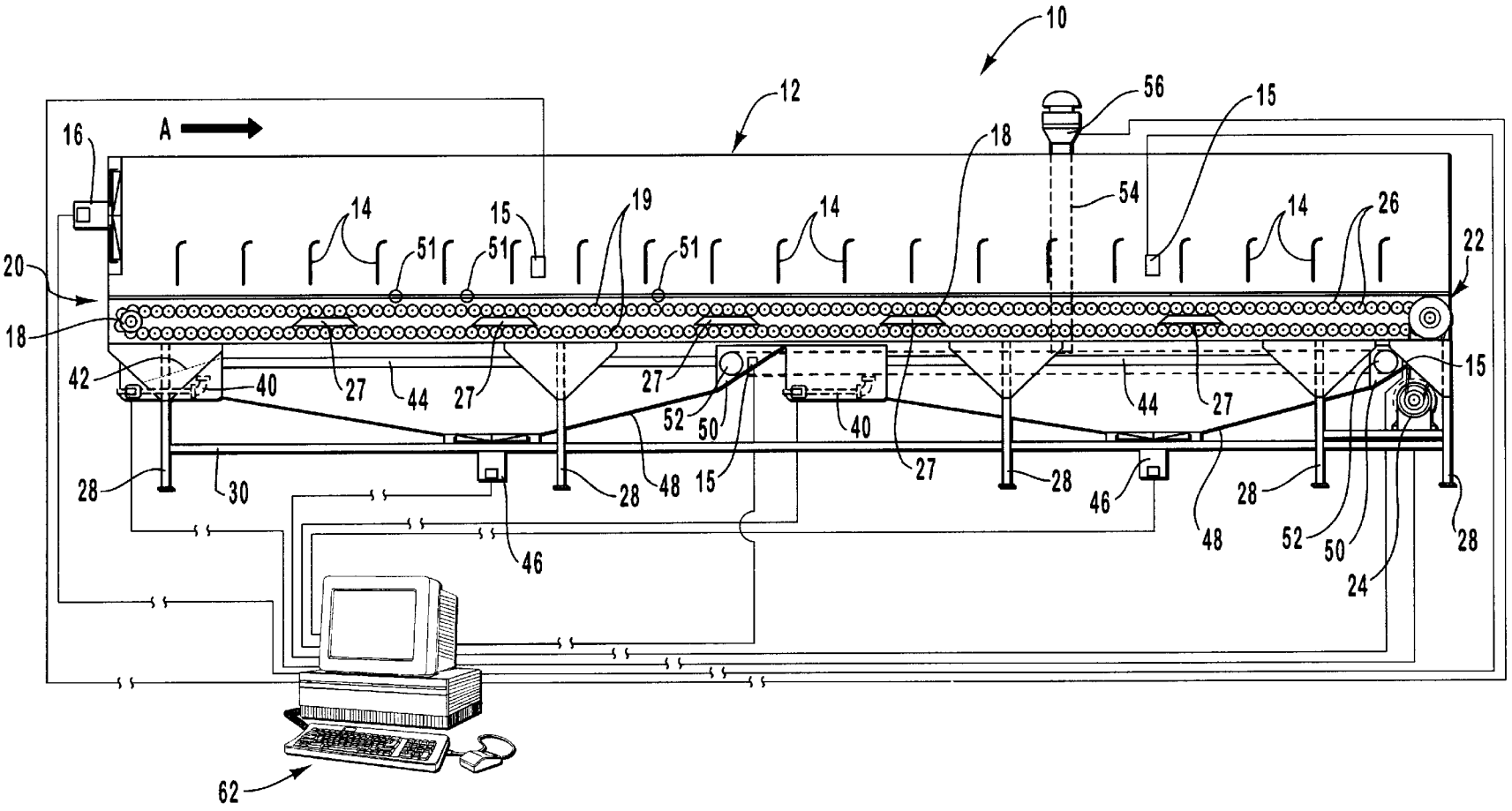
FIG. 1 is a side elevation, longitudinal section view of a large scale dryer constructed in accordance with the system and method of the present invention, also showing a representation of the monitoring system.

Referring first to FIG. 1, one presently preferred embodiment of the produce drying system of this invention is generally designated at 10. In the illustrated embodiment, the dryer 10 includes a drying hood assembly generally designated at 12. The drying hood assembly 12 includes baffles 14 periodically spaced to promote air flow turbulence towards the produce being conveyed (example produce or objects are designated at reference number 51). Sensors, such as thermostats and the like, 15 are included in the hood assembly 12 to provide sensory readings from various locations within the dryer 10. A conveyor 18 transports the produce 51 from an input end 20 to an output end 22 in the direction indicated by arrow A. The conveyor 18 is driven by a conveyor drive motor 24 and comprises an endless chain 19 (See FIG. 2) and a series of rollers 26. The rollers 26 are used to rotate the produce 51 thereon to facilitate even drying of the produce. The rollers 26 rotate upon engaging rotation ramps 27 disposed adjacent to the endless chain conveyor.

It should be understood that when dehydration of the produce is desired that rotation of the produce is less important to the drying process. Consequently, the conveyor 18 comprising an endless chain 19 of rollers 26 may be replaced by an endless interlocking belt, such as an interlocking plastic belt. The type of interlocking belt most suitable for the dehydration desired would be know to a person or ordinary skill in the art.

Figure 2:
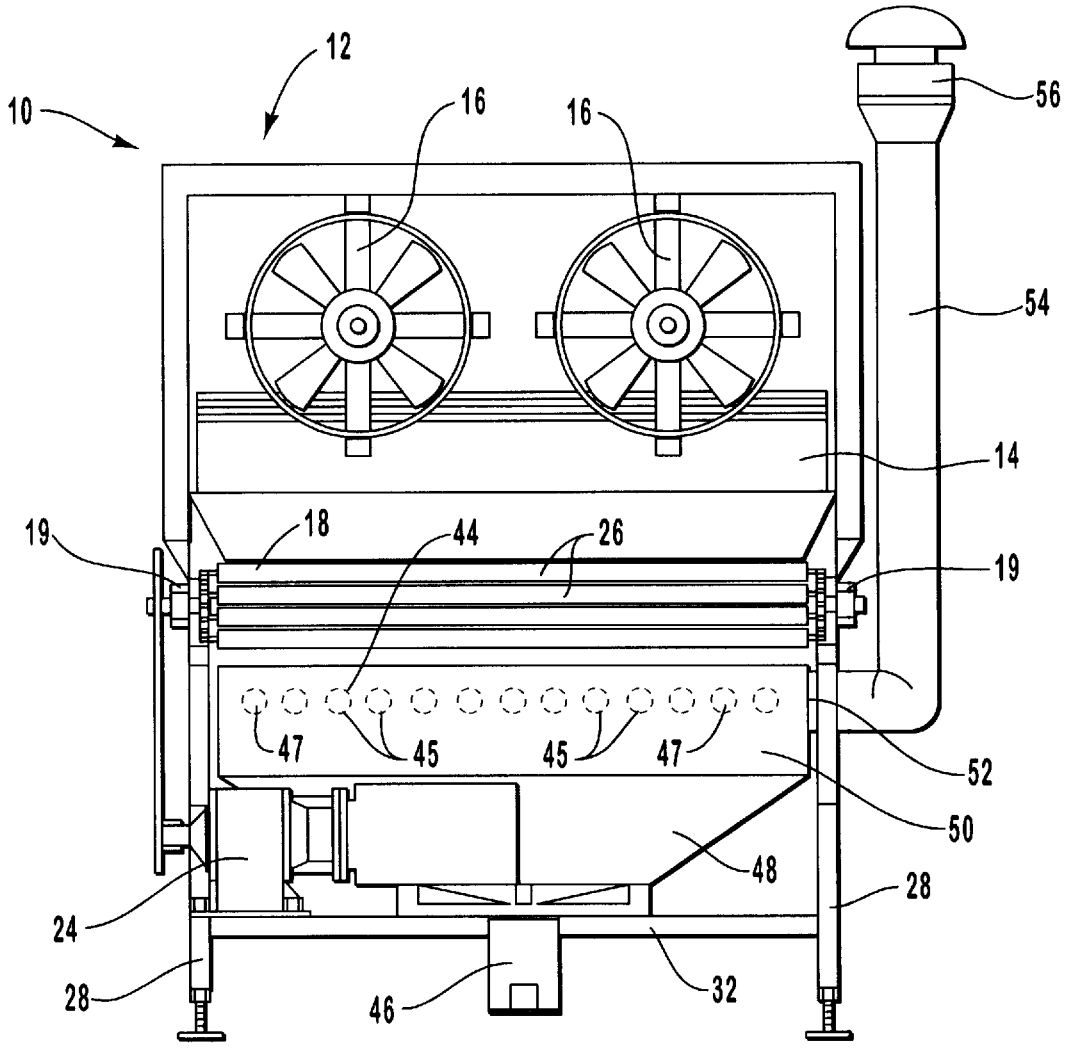
FIG. 2 is an end elevation, transverse section view illustrating in greater detail the location of the heat absorbing and radiating reservoir, the hollow of the heat-conductive members, hood fans, fan tray with blowing fan, conveyor drive motor, and dehumidifying chamber with the connected dehumidifying fan.

With continuing reference to FIG. 1, the hood assembly 12 and conveyor 18 are supported by supporting legs 28 and longitudinal braces 30. A lateral support brace 32 is shown in FIG. 2. The drying system 10 includes a gas burner 40 or other type of heating source located beneath the conveyor 18. A heat reservoir 44, preferably a series of hollow, heat-conductive members 45, such as metal tubes or pipes, is situated in heat transfer communication with the heating source 40. This is accomplished by locating the heating end of the heat reservoir 44 sufficiently near the burner 40 to cause heat to be transferred from the burner 40 to the heat reservoir 44. A burner deflector 42 is located near both the heating source 40 and the heat reservoir 44 to facilitate the transfer of heat from the heating source 40 to the heat reservoir 44. See also FIG. 3 and FIG. 4 wherein the heating source 40, burner deflector 42, and heat reservoir 44 are viewed from a top and side view, respectively.

With continuing reference to FIG. 1, a dehumidifying chamber 50 is in air flow communication with the dehumidifying end of the heat reservoir 44. The dehumidifying chamber 50 is used to draw moisture from the heat reservoir 44 to prevent rusting and corrosion. A suction port 52 is in air flow communication with both the dehumidifying chamber 50 and a motor with a suction fan 56. To permit air flow communication between the suction fan 56 and the suction port 52, a tuyere 54 is employed. The motor with suction fan 56 is preferably located above the hood 12 to emit the moist air drawn from the heat reservoir 44 into the atmosphere.

Referring again to FIG. 1, a blowing fan 46 and a fan tray 48 are located below the heat reservoir 44 and situated to direct air upwardly from below the heat reservoir 44 to the produce 51 being conveyed 18, thus forcing the heat from the heat reservoir 44 up and about the produce or objects 51 on the conveyor 18.

Figure 3:
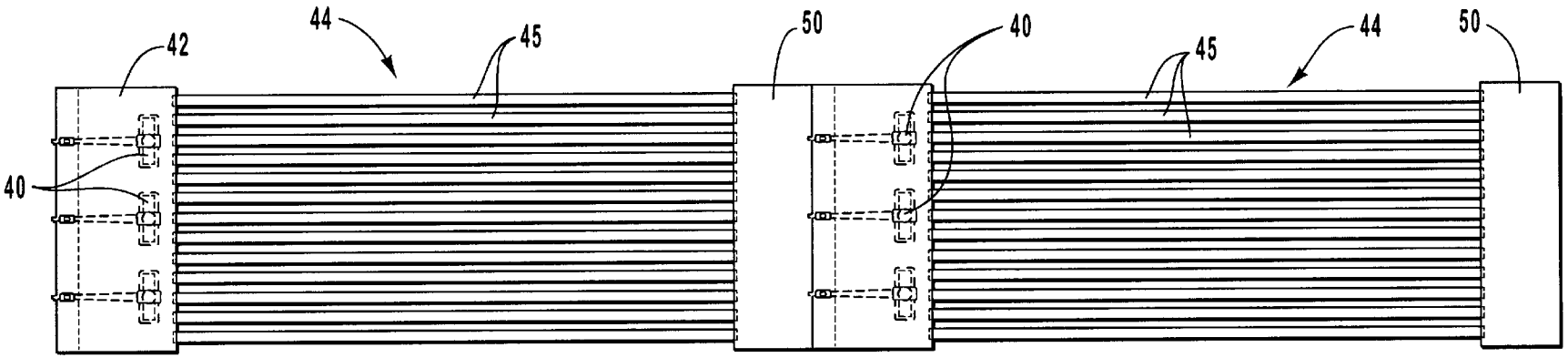
FIG. 3 is a top plan view of the heat source and heat reservoir which provides in greater detail the interrelationship between the heating source, burner deflectors, the heat-conductive members, and the dehumidifying chambers.
Figure 4:
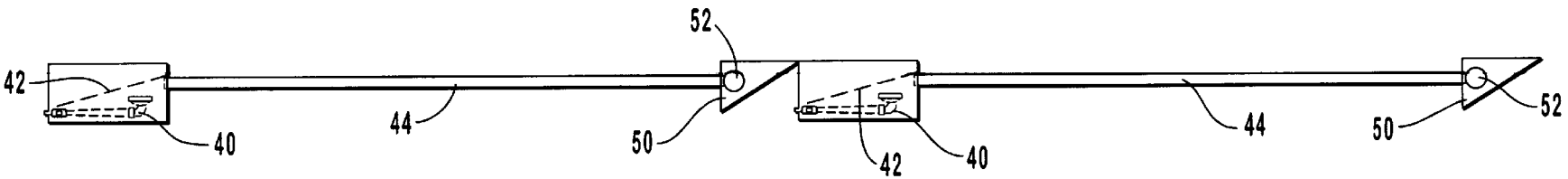
FIG. 4 is a side elevation view of the components shown in FIG. 3 illustrating further the interrelationship between the heating source, burner deflectors, the heat-conductive members, and the dehumidifying chambers.

FIG. 3 shows the relationship between the heat reservoir 44, burn deflectors 42, heat sources 40, and dehumidifying chamber 50. It is preferred that the heat-conductive members 45 be disposed in parallel, spaced arrangement. This disposition allows for the flow and heating of air between adjacent heat-conductive members 45. FIG. 4 shows the relationship between the heat reservoir 44, burn deflectors 42, heat sources 40, and dehumidifying chamber 50. As shown in FIG. 2, the heat reservoir 44 has a hollow 47, shown as the inner region of each hollow, heat-conductive member 45. The hollow 47 is a continuous opening from the heating end of the heat reservoir 44 to the dehumidifying end of the heat reservoir 44. The hollow 47, at the dehumidifying end of the heat reservoir 44, is in air transfer communication with the dehumidifying chamber 50.

A monitoring and controlling system 62 is used to receive sensory readings from sensors 15 disposed at various locations in the dryer 10. The monitoring and controlling system 62 receives the sensory readings taken, compares the readings to predetermined criteria for optimum operation of the dryer 10, and sends controlling signals to the heat source 40, the hood fans 16, the blowing fans 46, the conveyor drive motor 24, and the dehumidifying fan 56 to regulate the operation of each, whereby optimum drying conditions for objects 51 conveyed may be maintained. The monitoring and controlling system 62 regulates the on/off condition of the heat source 40, the speed at which the conveyor drive motor 24 drives the conveyor 18, and the activation/deactivation of the hood fans 16, the blowing fans 46, and the dehumidifying fan 56.

The presently preferred method for operating the produce drying system 10 of the present invention is to monitor and adjust the speed of the conveyor drive motor 24, the hood fans 16, the heating source 40, blowing fans 46, and the dehumidifying fan 56 to optimally dry the particular kind of produce 51 desired to be dried or dehydrated. The predetermined criteria for optimum operation of the dryer 10 varies with different types and conditions of the produce 51. A person of ordinary skill in the art can readily determine the appropriate criteria and set the standards for optimum operation for produce 51 under various conditions. The preferred monitoring and controlling system 62 would comprise a computer, but other monitoring systems are contemplated. The computer, for example, may receive a sensory reading of a temperature in excess of the optimum temperature. In that event, controlling signals would be sent to the heat source 40 to alter its on/off condition from "on" to "off." Additionally, the speed of the conveyor may be increase slightly to reduce the time that the produce 51 is exposed to the excess heat, and the hood fans 16 and blowing fans may be turned on or turned to a higher speed to assist in reducing the temperature within the drying hood assembly 12.

The produce 51 enters the drying hood assembly 12 at the input end 20, is heated as it travels from the input end 20 through the drying hood assembly 12, and exits from the drying hood assembly 12 at the output end 22. Heating is accomplished by activating the heating source 40 thereby heating the heat reservoir 44. The individual heat-conductive members 45 conduct heat through the length of the heat-conductive member 45 and radiate heat to the air proximate thereto. The burner deflector 42 aids in a more efficient transfer of heat from the heating source 40 to the heat reservoir 44. To further facilitate the circulation of the heated air around the produce 51 being conveyed on the conveyor 18, the blowing fans 46 may be activated to direct heated air upward between the heat-conductive members 45 and about the conveyed produce 51. The fan tray 48 aids in controlling the air flow from the blowing fan 46. The hood fan 16 and periodic baffles 14 also serve to promote air flow turbulence about the produce 51 being conveyed.

It is desirable in the operation of the drying system 10 of the present invention to dehumidify the hollow 47 of the heat reservoir 44. This is preferably accomplished through connecting a dehumidifying chamber 50 to the hollow 47 of the heat reservoir 44 at the end opposite the heat source 40. Attached to the dehumidifying chamber 50 and in air flow communication therewith is a suction port 52 and the venting tuyere 54. The venting tuyere 54 is in air flow communication with a dehumidifying fan 56. The dehumidifying fan 56 operates to draw moist air out of the hollow 47 of the heat reservoir 44, through the dehumidifying chamber 50, out the suction port 52, through the venting tuyere 54, and out into the atmosphere.

Figure 5:
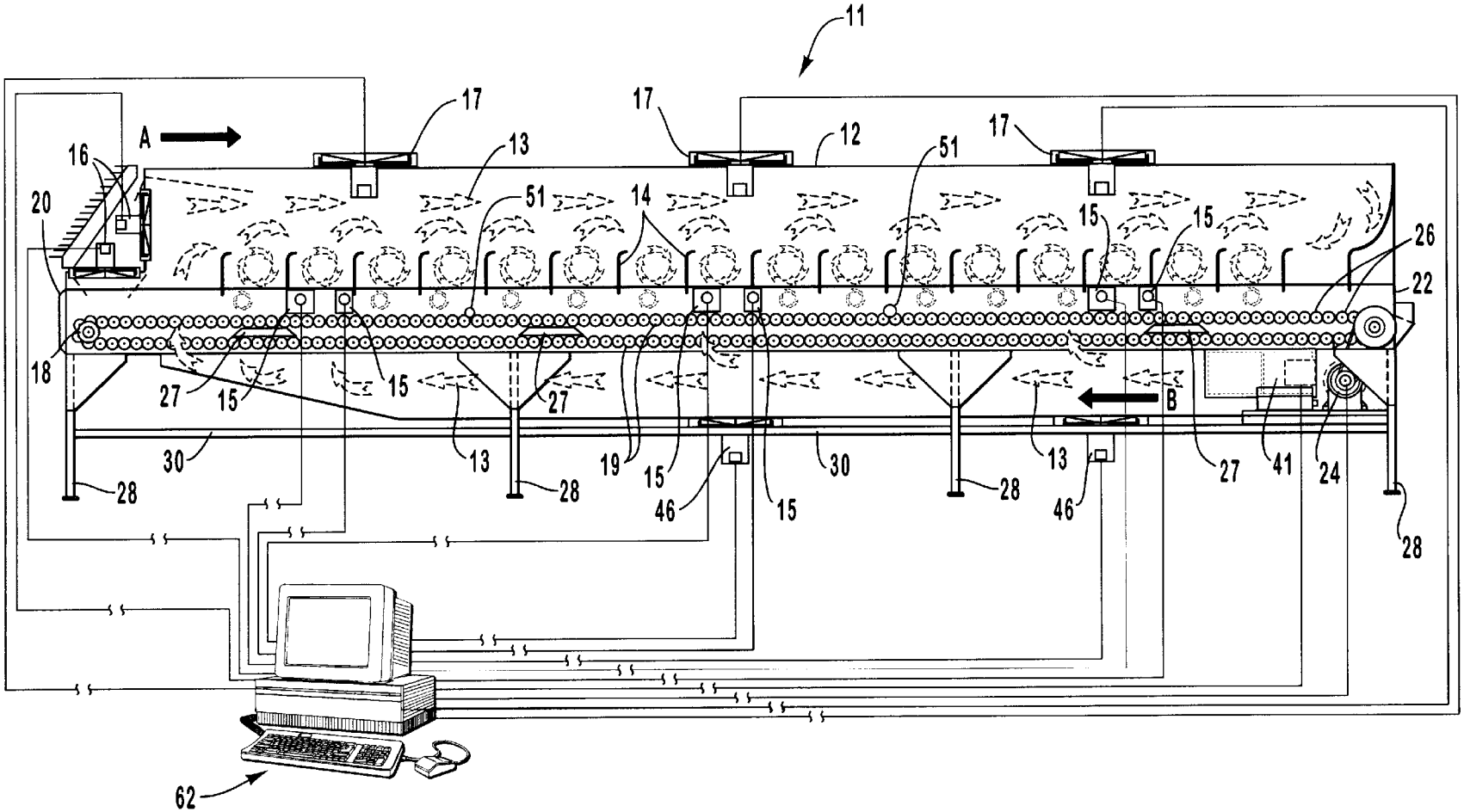
FIG. 5 is a side elevation, longitudinal section view of another embodiment of the large scale dryer constructed in accordance with the system and method of the present invention, illustrating the configuration wherein heated air is introduced beneath the conveyed produce at the output end of the drying chamber and air baffles and fans facilitate air flow circulation about the produce.
Figure 6:
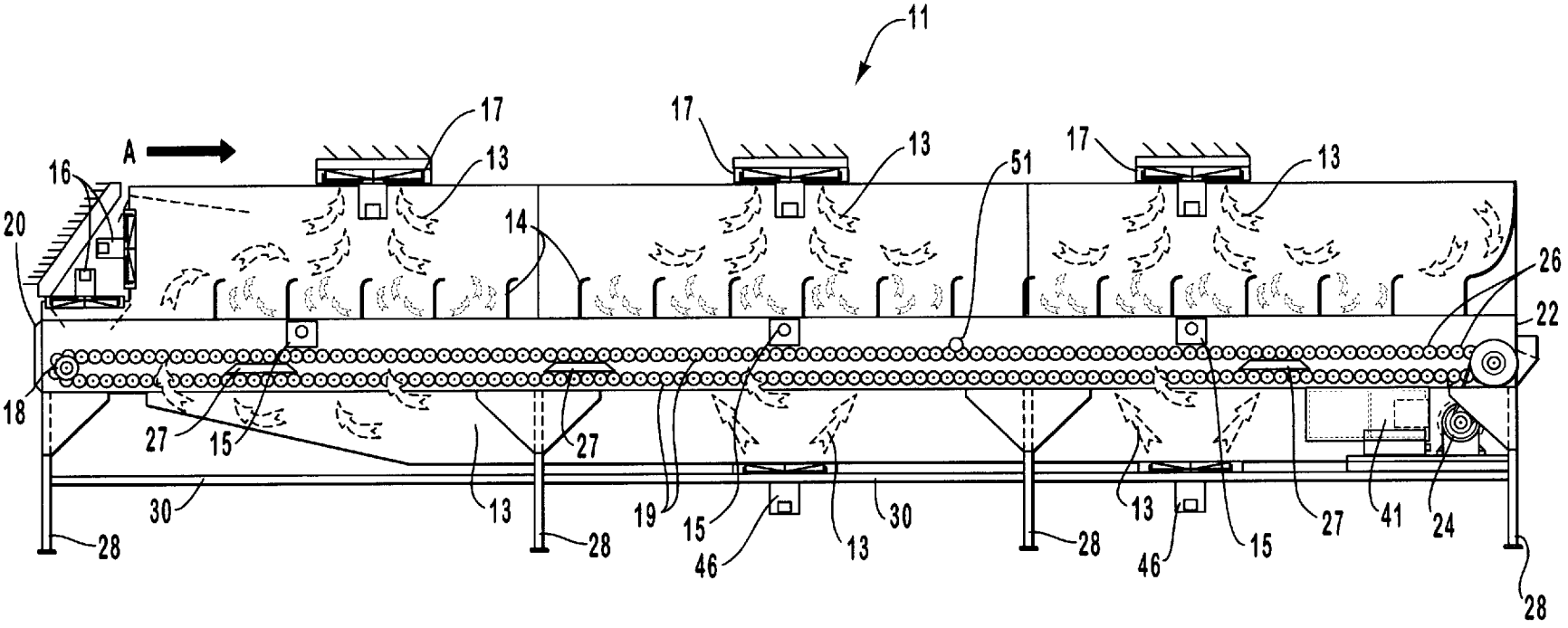
FIG. 6 is a side elevation, longitudinal section view of an embodiment of the large scale dryer construction, illustrating the air flow paths when the exhaust and blow fans are operating.
Figure 7:
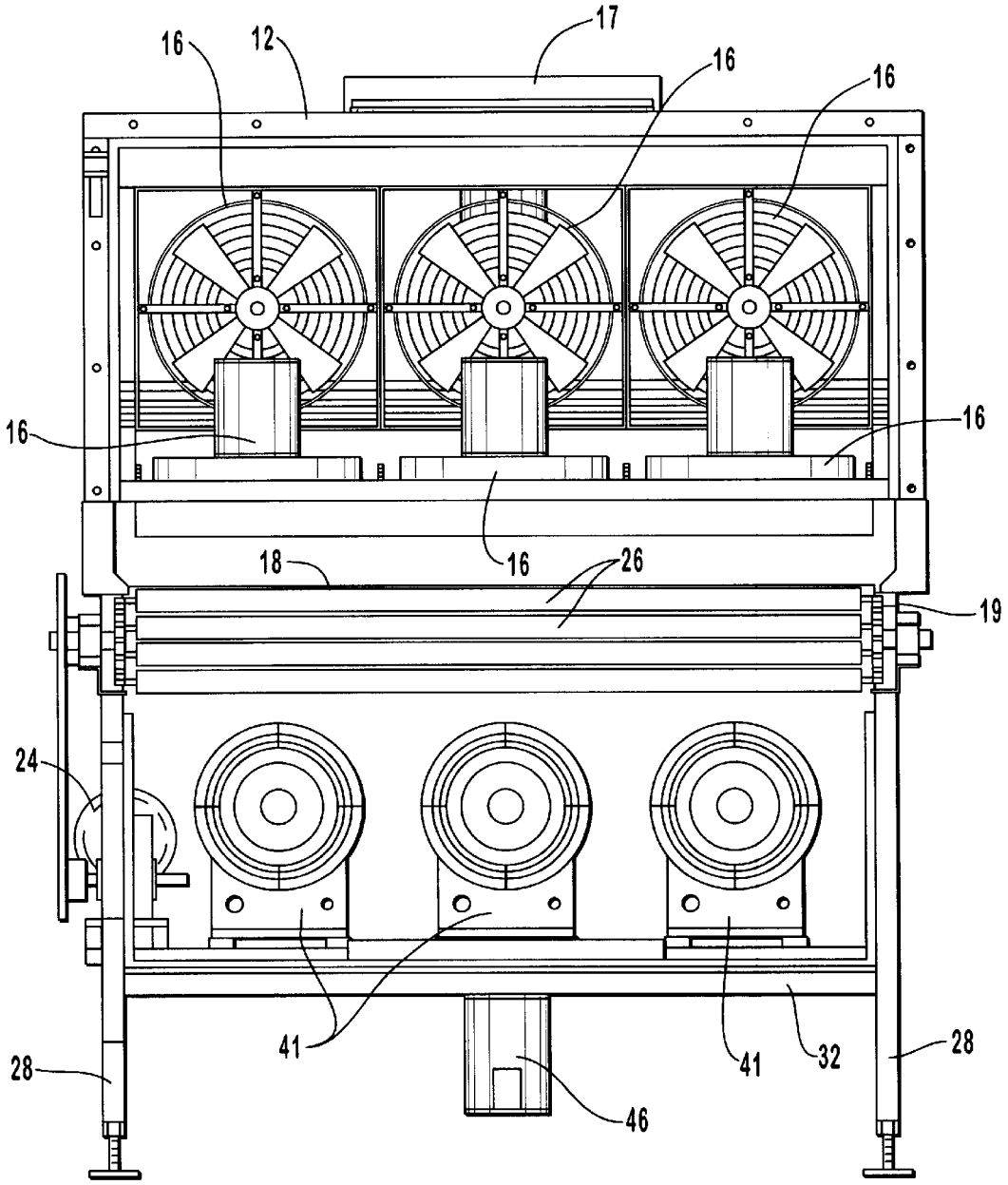
FIG. 7 is an end elevation, transverse section view of an embodiment of the large scale dryer, illustrating in greater detail the location of the heating source beneath the conveyor, along with the relative location of the hood fans, exhaust fans, and the blower fans.

FIGS. 5, 6 and 7 represent another embodiment of the present invention. Referring to FIG. 5, this embodiment of the produce drying system of this invention is generally designated at 11. In the illustrated embodiment, the dryer 11 includes a drying hood assembly generally designated at 12. The drying hood assembly 12 includes baffles 14 periodically spaced to promote air flow turbulence towards and around the produce being conveyed (example produce or objects are designated at reference number 51). Sensors, such as humidistats and thermostats and the like 15, are included in the hood assembly 12 to provide sensory readings from various locations within the dryer 11. A conveyor 18 transports the produce 51 from an input end 20 to an output end 22 in the direction indicated by arrow A. The conveyor 18 is driven by a conveyor drive motor 24 and comprises an endless chain 19 (See FIG. 2) and a series of rollers 26. The rollers are used to rotate the produce 51 thereon to facilitate even drying of the produce. The rollers 26 rotate upon engaging rotation ramps 27 disposed adjacent to the endless chain conveyor 18.

With continuing reference to FIG. 5, the hood assembly 12 and conveyor 18 are supported by supporting legs 28 and longitudinal braces 30. The drying system 11 includes a propane heater 41 or other type of heating source located beneath the conveyor 18 and at the output end 22 of the drying assembly 12. Exhaust fans 17 are periodically spaced in the drying assembly 12 above the conveyor 18. Heated air is thus introduced under the conveyor in a direction opposite the direction traveled by the conveyed produce as indicated by arrow B. Hood fans 16 and periodically spaced air baffles 14 facilitate the circulation of the heated air about the produce 51 traveling on the conveyor belt 18 through the hood assembly 12. Air flow directional arrows, designated as 13, illustrate the flow of air through the drying assembly 12.

FIG. 6 illustrates the operation of the exhaust fans 17 with blowing fans 46 to remove moist air from the drying assembly 12. Air flow directional arrows 13 demonstrate air flow patterns in the exhaust process.

With continuing reference to FIG. 5, a monitoring and controlling system 62 is used to receive sensory readings from sensors 15 disposed at various locations in the dryer 11. The monitoring and controlling system 62 receives the sensory readings, compares the readings to predetermined criteria for optimum operation of the dryer 11, and sends controlling signals to the heat source 41, the hood fans 16, the blowing fans 46, the conveyor drive motor 24, and the exhaust fans 17 to regulate the operation of each, whereby optimum drying conditions for objects 51 conveyed may be maintained. The monitoring and controlling system 62 regulates the on/off condition of the heat source 41, the speed at which the conveyor drive motor 24 drives the conveyor 18, and the activation/de-activation of the hood fans 16, the blowing fans 46, and the exhaust fans 17.

FIG. 7 is an end elevation view of the components shown in FIG. 5 illustrating further the interrelationship between the heating source 41, exhaust fans 17, hood fans 16, and blowing fans 46.

The presently preferred method for operating the produce drying system 11 of this embodiment of the present invention is to monitor and adjust the speed of the conveyor drive motor 24, the hood fans 16, the heating source 41, blowing fans 46, and the exhaust fans 17 to optimally dry the particular kind of produce 51 desired to be dried or dehydrated. The predetermined criteria for optimum operation of the dryer 11 varies with different types and conditions of the produce 51. A person of ordinary skill in the art can readily determine the appropriate criteria and set the standards for optimum operation for produce 51 under various conditions. The preferred monitoring and controlling system 62 would comprise a computer, but other monitoring systems are contemplated. The computer, for example, may receive a sensory reading of a temperature in excess of the optimum temperature. In that event, controlling signals would be sent to the heat source 41 to alter its on/off condition from "on" to "off." Additionally, the speed of the conveyor may be increased slightly to reduce the time that the produce 51 is exposed to the excess heat, and the hood fans 16 and blowing fans may be turned on or turned to a higher speed to assist in reducing the temperature within the drying hood assembly 12.

The produce 51 enters the drying hood assembly 12 at the input end 20, is heated as it travels from the input end 20 through the drying hood assembly 12, and exits from the drying hood assembly 12 at the output end 22. Heating is accomplished by activating the heating source 41 thereby introducing heated air into the drying assembly at the output end 22 below the path traveled by the produce. The heated air travels in a horizontal direction opposite the path traveled by the produce 51 on the conveyor belt 18 and in also rises up through the produce. (See FIG. 5). To further facilitate the circulation of the heated air around the produce 51 being conveyed on the conveyor 18, the hood fans 16 are activated and air flow baffles 14 are strategically located, causing turbulence and the circulation 13 of the heated air around the produce.

Referring now to FIG. 6, in this alternative embodiment of the present invention, the exhaust fans 17 and blowing fans 46 may be activated to remove unwanted moist air from the drying hood assembly 12, as illustrated by the air flow arrows 13.

While the system and method of the present invention has been described in reference to the presently preferred embodiment as illustrated and described in connection with FIGS. 1–7, the invention may be embodied in other specific forms without departing from its spirit or essential characteristics. Thus, the described embodiment is to be considered in all respects only as illustrative and not restrictive and the scope of the invention. The invention is, therefore, indicated by the appended claims rather than by the foregoing description. All changes which come within the meaning and range of equivalency of the claims are to be embraced within their scope.

The scope of the invention should be determined by the appended claims and their legal equivalents, rather than by the examples given herein.

What is claimed and desired to be secured by united states letters patent is:

1. A dryer for drying objects as the objects are conveyed from an input end to an output end comprising:

a continuous conveyor for transporting the objects in a substantially horizontal path from the input end to the output end;

a heat source;

a heat reservoir comprised of at least one hollow, heat-conductive member for radiating heat, said heat reservoir disposed beneath said objects being conveyed, said heat reservoir in heat transfer communication with said heat source; and a drying hood assembly for substantially enclosing a volume above said heat reservoir and at least a portion of said continuous conveyor, said drying hood assembly comprising a hood, a plurality of air baffles disposed near said continuous conveyor, and a hood fan to facilitate air flow turbulence about said air baffles within said drying hood assembly.

2. The dryer as defined in claim 1 wherein said continuous conveyor comprises:

an endless chain extending from the input end to the output end; and a conveyor drive for driving said endless chain.

3. The dryer as defined in claim 2 further comprising a plurality of rollers connected to said endless chain and disposed transverse to the path travelled by said endless chain for providing rotatable support for objects being conveyed.

4. The dryer as defined in claim 3 further comprising rotation control means for interacting with said rollers to rotate the objects supported thereon.

5. The dryer as defined in claim 1 wherein said heat source comprises a gas burner.

6. The dryer as defined in claim 1 further comprising a heat deflector to enhance the heat transfer communication between said heat source and said heat reservoir.

7. The dryer as defined in claim 1 further comprising an extraction means for drawing moist air from the hollow of said heat-conductive member.

8. The dryer as defined in claim 7 wherein said extraction means comprises:

a dehumidifying chamber in communication with the hollow of said heat-conductive member;

a venting tuyer in communication with said dehumidifying chamber; and a dehumidifying fan in communication with said dehumidifying chamber through said venting tuyere whereby moist air may be drawn from the hollow of said heat-conductive member through said dehumidifying chamber and said venting tuyere and vented into the atmosphere.

9. The dryer as defined in claim 1 further comprising a blowing fan directed substantially vertically, said blowing fan disposed beneath said heat reservoir whereby air heated by radiated heat from said heat reservoir is directed upward to the objects being conveyed.

10. A dryer for drying objects as the objects are conveyed from an input end to an output end comprising:

a continuous conveyor for transporting the objects in a substantially horizontal path from the input end to the output end;

a plurality of heat sources;

a heat reservoir for radiating heat, said heat reservoir disposed beneath said objects being conveyed, said heat reservoir comprising a plurality of hollow, heat-conductive members, each of said hollow, heat-conductive members being disposed in heat transfer communication with at least one of said heat sources; and a drying hood assembly for substantially enclosing a volume above said heat reservoir and at least a portion of said continuous conveyor, said drying hood assembly comprising a hood, a plurality of air baffles disposed near said continuous conveyor, and a hood fan to facilitate air flow turbulence about said air baffles within said drying hood assembly.

11. The dryer as defined in claim 10 wherein said continuous conveyor comprises:

an endless chain extending from the input end to the output end; and a conveyor drive for driving said endless chain.

12. The dryer as defined in claim 11 further comprising a plurality of rollers connected to said endless chain and disposed transverse to the path travelled by said endless chain for providing rotatable support for objects being conveyed.

13. The dryer as defined in claim 12 further comprising rotation control means for interacting with said rollers to rotate the objects supported thereon.

14. The dryer as defined in claim 10 wherein said heat sources comprise gas burners.

15. The dryer as defined in claim 10 further comprising a plurality of heat deflectors to enhance the heat transfer communication between said heat sources and said heat reservoir.

16. The dryer as defined in claim 10 further comprising an extraction means for drawing moist air from the hollow of said heat-conductive members.

17. The dryer as defined in claim 16 wherein said extraction means comprises:

a dehumidifying chamber in communication with the hollow of said heat-conductive members;

a venting tuyere in communication with said dehumidifying chamber; and a dehumidifying fan in communication with said dehumidifying chamber through said venting tuyere whereby moist air may be drawn from the hollow of said heat-conductive members through said dehumidifying chamber and said venting tuyere and vented into the atmosphere.

18. The dryer as defined in claim 10 wherein said hollow, heat-conductive members are arranged in parallel spaced disposition such that adjacent heat-conductive members define an air space therebetween.

19. The dryer as defined in claim 18 further comprising a blowing fan directed substantially vertically, said blowing fan disposed beneath said heat-conductive members whereby air in the air space heated by radiated heat from said heat-conductive members may be directed upward to the objects being conveyed.

20. A dryer for drying objects as the objects are conveyed from an input end to an output end comprising:

a continuous conveyor for transporting the objects in a substantially horizontal path from the input end to the output end;

a heat source located below said conveyor and adjacent to said output end of said conveyor; and a drying hood assembly for substantially enclosing a volume above at least a portion of said continuous conveyor, said drying hood assembly comprising a hood, a plurality of air baffles disposed above said continuous conveyor, at least one exhaust fan, and at least one hood fan to facilitate air flow turbulence about said air baffles within said drying hood assembly.

21. The dryer as defined in claim 20 wherein said continuous conveyor comprises:

an endless chain extending from the input end to the output end; and a conveyor drive for driving said endless chain.

22. The dryer as defined in claim 21 further comprising a plurality of rollers connected to said endless chain and disposed transverse to the path travelled by said endless chain for providing rotatable support for objects being conveyed.

23. The dryer as defined in claim 22 further comprising rotation control means for interacting with said rollers to rotate the objects supported thereon.

24. The dryer as defined in claim 20 wherein said heat source comprises a propane heater.

25. The dryer as defined in claim 20 further comprising at least one blowing fan directed substantially vertically, said blowing fan disposed beneath said conveyor and directed upward to the objects being conveyed.

* * * * *